United States Patent [19]

Kramer et al.

[11] 3,999,489

[45] Dec. 28, 1976

[54] SLIDING WALL ARRANGEMENT FOR COVERED RAILROAD FREIGHT CARS

[75] Inventors: Rolf Kramer, Siegen; Felix Schneider; Paul-Werner Wagener, both of Netphen, all of Germany

[73] Assignee: Waggon Union GmbH, Germany

[22] Filed: Dec. 15, 1975

[21] Appl. No.: 640,758

[30] Foreign Application Priority Data

Dec. 18, 1974 Germany ..... 2459777

[52] U.S. Cl. ..... 105/378; 49/127; 49/130; 49/222; 160/197

[51] Int. Cl.[2] ..... B61D 17/08

[58] Field of Search ..... 105/378, 376, 379; 49/127, 128, 130, 222; 160/197, 202

[56] References Cited

UNITED STATES PATENTS 3,828,693 8/1974 Kampmann ..... 105/378

FOREIGN PATENTS OR APPLICATIONS 1,964,814 12/1969 Germany ..... 105/378

*Primary Examiner*—Robert J. Spar
*Assistant Examiner*—George F. Abraham
*Attorney, Agent, or Firm*—McGlew and Tuttle

[57] ABSTRACT

The sliding wall includes a central wall section and two end wall sections, with the sections being co-planar in the closed state and movable, transversely of the car, out of the closing plane and into a shifting plane in which they are displaceable longitudinally of the car past closed wall sections. During shifting, the sliding wall sections are supported by rollers engageable with a rail, provided in an upper longitudinal stringer, and with the outer lateral surface of an outer lower longitudinal supporting beam, the stringer and the supporting beam forming, in cooperation with two corner posts, a side frame of the freight car. The upper rail is a single rectilinear and uninterrupted rail extending substantially the full length of the upper stringer. Each end section has, in the upper portion of its end adjacent the central section, an outwardly opening pocket having a horizontal catch member extending thereacross. The central section has, at the upper portion of each of its ends adjacent an end section, a sickle-shape catch lever pivotal on a horizontal axis parallel to the length of the car and, in the closing position of the sections, projecting into the pocket of the adjacent end section and engaging behind the catch member. Angle levers are oscillatable about horizontal pivots adjacent the bottom end of the central or center section and carry ball rollers on one end engageable with the supporting beam and, on their other end, hook portions which can pass through cut-outs in the supporting beam to engage against the inner lateral surface thereof. The catch levers and the angle levers are commonly operated by a known actuating mechanism. An oscillatable shaft supports the central section during its movement between the closing and shifting planes. When the center section is shifted to completely overlap an end section, the end section may also be shifted together with the center section. For this purpose, the upper edge of the central or center section has cut-outs permitting the supporting rollers of the end section to move from the closing plane into the shifting plane.

10 Claims, 4 Drawing Figures

SLIDING WALL ARRANGEMENT FOR COVERED RAILROAD FREIGHT CARS

FIELD AND BACKGROUND OF THE INVENTION

The present invention relates to a sliding wall arrangement for covered railroad freight cars, wherein the sliding wall sections, which are co-planar in the closed state, are movable, transversely of the car by means of respective hand levers and actuating linkage connected thereto, out of the closing plane into a shifting plane for engagement with running rails on which they can be shifted, by means of rollers in the longitudinal direction of the car, past closed wall sections, in order to clear the opening. A single, rectilinear uninterrupted running rail is provided in the upper stringer of the side wall frame, and the outer lateral surface of the outer longitudinal beam forms the running-on surface for the bottom edge of the sliding wall sections.

In accordance with U.S. Pat. No. 3,828,693, at least two rollers or guide forks, respective to each sliding wall section, are provided on the free ends of levers which are secured to shafts pivotable by means of the actuating linkage for oscillation transversely of the car and, in the floor and adjacent the outer longitudinal beam, brackets are provided which, in swung-out position, have their outside web portions conformingly seated in mating cutouts of the outer beam. These brackets are pivotable transversely of the car by means of levers acting as a parallel guide and coupled, through shafts, to the actuating linkage. The sliding wall sections carry, at their top, running rollers rotatable on supporting arms about horizontal axes and supporting cams cooperating with the rollers or guide forks and, at their bottom, supporting arms on the free ends of which rollers rotatable about vertical axes and guide channels embracing a vertical web plate at the bottom of the longitudinal beam or the brackets are provided. The sliding wall sections are movable from the closing plane into the shifting plane, at the top, by means of the rollers or guide forks and, at the bottom, by means of the brackets.

On their outside, the supporting arms are formed with vertical surfaces which, in the closing position of the sliding wall sections, form a flush closure for the cut-outs of the longitudinal beam, in the running plane of the rollers. Due to this design of the sliding wall sections in accordance with the U.S. patent mentioned above, all sliding wall sections can be made identical so that they are easily interchangeable as to their position, both during assembly and in operation. The sealing of the sliding wall sections against each other is effected, in a well known manner, for example, by means of rubber packing strips. To be able to effect the sealing also by means of metallic labyrinth packings which, in rail vehicle construction and, particularly, in the construction of freight cars, are advantageous, the sliding wall sections must either be guided, in the last phase of their closing motion, obliquely against each other, or they must overlap with their vertical sealing edges. With closures comprising two sliding wall sections, with or without central posts, it has proved advantageous to guide the sliding wall sections, in the last phase of their closing motion, obliquely relative to the longitudinal axis of the car and to the adjacent sliding wall section. In this case, a metallic labyrinth packing can be used in which the sliding wall sections interengage on their front sides. The same arrangement may be used with closures comprising four sliding wall sections and a central post.

With a closure comprising three sliding wall sections which, ordinarily, is designed with a central post, this arrangement cannot be used. For lading reasons, such trisectional sliding walls require opening of the central sliding wall section first. Then, if metallic labyrinth packings are used for sealing the sliding wall sections against each other, the end sliding wall sections must first be brought into closing position and it is only thereupon that the central sliding wall section can be closed. This necessity, however, requires a different design and actuation of the central sliding wall section as compared to the end sliding wall sections.

SUMMARY OF THE INVENTION

The present invention is directed to a modification of the sliding wall arrangement and actuation according to U.S. Pat. No. 3,828,693 so as to make it suitable for a tri-sectional sliding wall.

While providing a sliding wall arrangement of the kind mentioned above and using the sliding wall actuation of U.S. Pat. No. 3,828,693 for the end sliding wall sections, in a sliding wall comprising three sections, it is provided, in accordance with the invention, that each of the end sliding wall sections has, in the upper portion of its end facing the central wall section, a pocket and a catch member mounted horizontally in front thereof, and that the central sliding wall section is provided, on the upper portion of each of its ends adjacent the near ends of the respective end sliding wall sections, with a sickle-shape catch lever which is carried by a rotatably mounted pivot extending horizontally in the longitudinal direction of the car and which, in the closing position of the sliding wall sections, projects into the pocket of the respective adjacent end sliding wall section and engages behind the catch member. Further, at the bottom of the central sliding wall section, angle levers are mounted on a horizontal shaft for pivoting thereabout and provided, on one of their free ends, with a respective ball roller and, on their other free ends, with a respective hook portion which, in closing position of the sliding wall sections, extends through cut-outs of the outer longitudinal beam and engage against the inner lateral surface thereof. The catch levers and the angle levers are connected to and are pivotable by an actuating mechanism which is mounted on the central sliding wall section. The central sliding wall section is guided, during its pivoting out of the closing position into the shifting position, by a shaft which is rotatably mounted on the upper stringer in the zone of the central sliding wall section and which, in a known manner, carries, on its free ends, at least two upwardly projecting levers provided with guide forks or rollers against which, in the closing and shifting positions, engage supporting cams on the upper horizontal edge of the central sliding wall section. In a variation of the embodiment, the catch member may be designed as a shaft carrying a rotatable roller.

Due to this inventive design of the central sliding wall section, the construction of the end sliding wall sections in accordance with the above-mentioned U.S. patent can be maintained, whereby a simplification and unification of the wall system is obtained. The shaft rotatably mounted on the upper stringer is provided as in the mentioned U.S. patent, but without a separate actuation, which makes it possible to design substantial component parts of the central sliding wall section to be identical with those of the end sliding wall sections.

According to a development of the invention, the angle levers may be secured to a common pivotable shaft at the lower horizontal edge of the central sliding wall section. This makes it possible to provide a plurality of angle levers, which is advantageous for a firm clamping of the central sliding wall section to the outer longitudinal beam of the undercarriage.

At the upper edge of the central sliding wall section, cut-outs are provided having at least the width of the supporting arms of the running rollers of the end sliding wall sections, and are located so that, with the central sliding wall section shifted into one of its end positions in front of an end sliding wall section, the cut-outs are aligned, considered in the transverse direction of the car, with the supporting arms of the running rollers of the end sliding wall section. The provision of these cutouts is necessary for obtaining the needed free space for lifting and shifting the end sliding wall sections and, also, for obtaining an interengagement of the two sliding wall sections while shifting them simultaneously along the side wall frame.

An object of the invention is to provide an improved sliding wall arrangement for railroad freight cars comprising a central wall section and two end wall sections.

Another object of the invention is to provide such a three-section sliding wall arrangement in which the central section has a design essentially similar to that of the two end sections.

A further object of the invention is to provide such an improved sliding wall arrangement for railroad freight cars which is simple and relatively inexpensive to construct.

For an understanding of the principles of the invention, reference is made to the following description of a typical embodiment thereof as illustrated in the accompanying drawings.

DESCRIPTION OF THE PREFERRED EMBODIMENT

Figure 1:
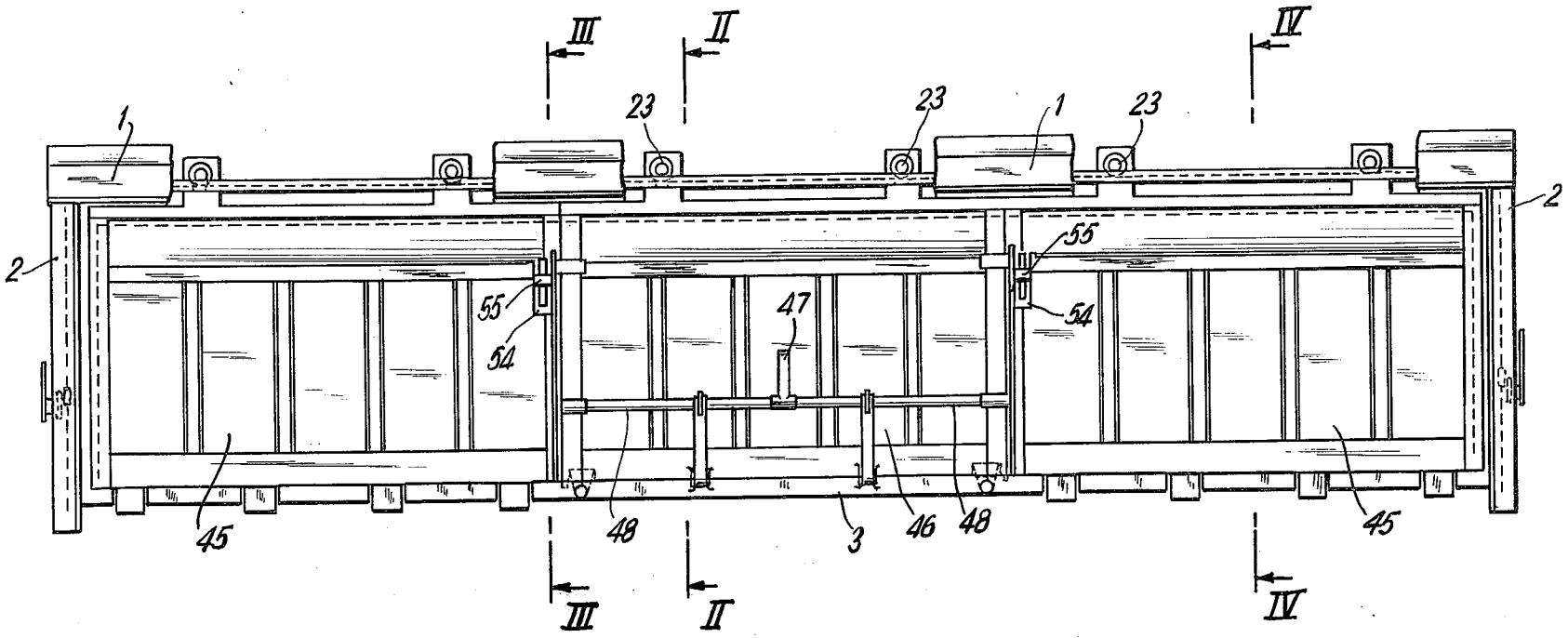
FIG. 1 is a lateral elevation view, partly in section, of a sliding wall of a covered railroad freight car in accordance with the invention.
Figure 2:
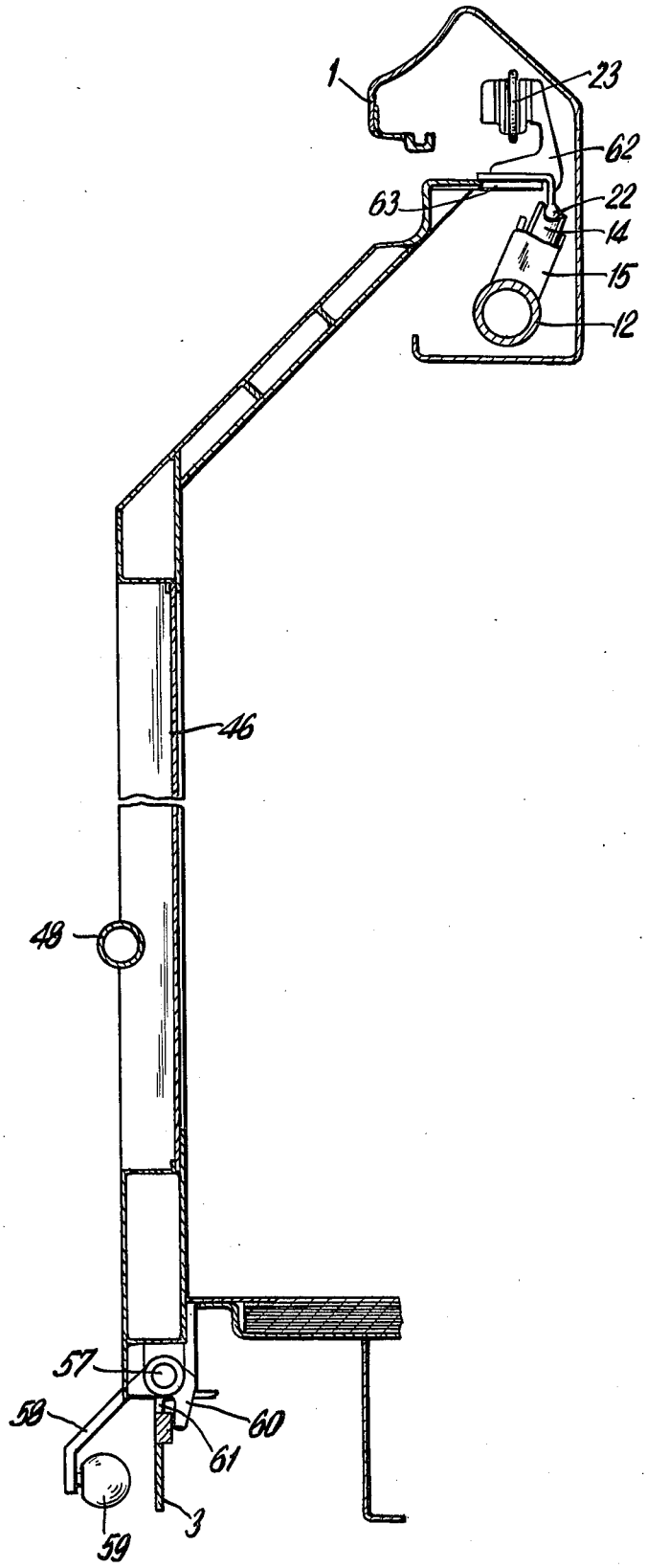
FIG. 2 is a sectional view taken along the line II—II of FIG. 1.
Figure 3:
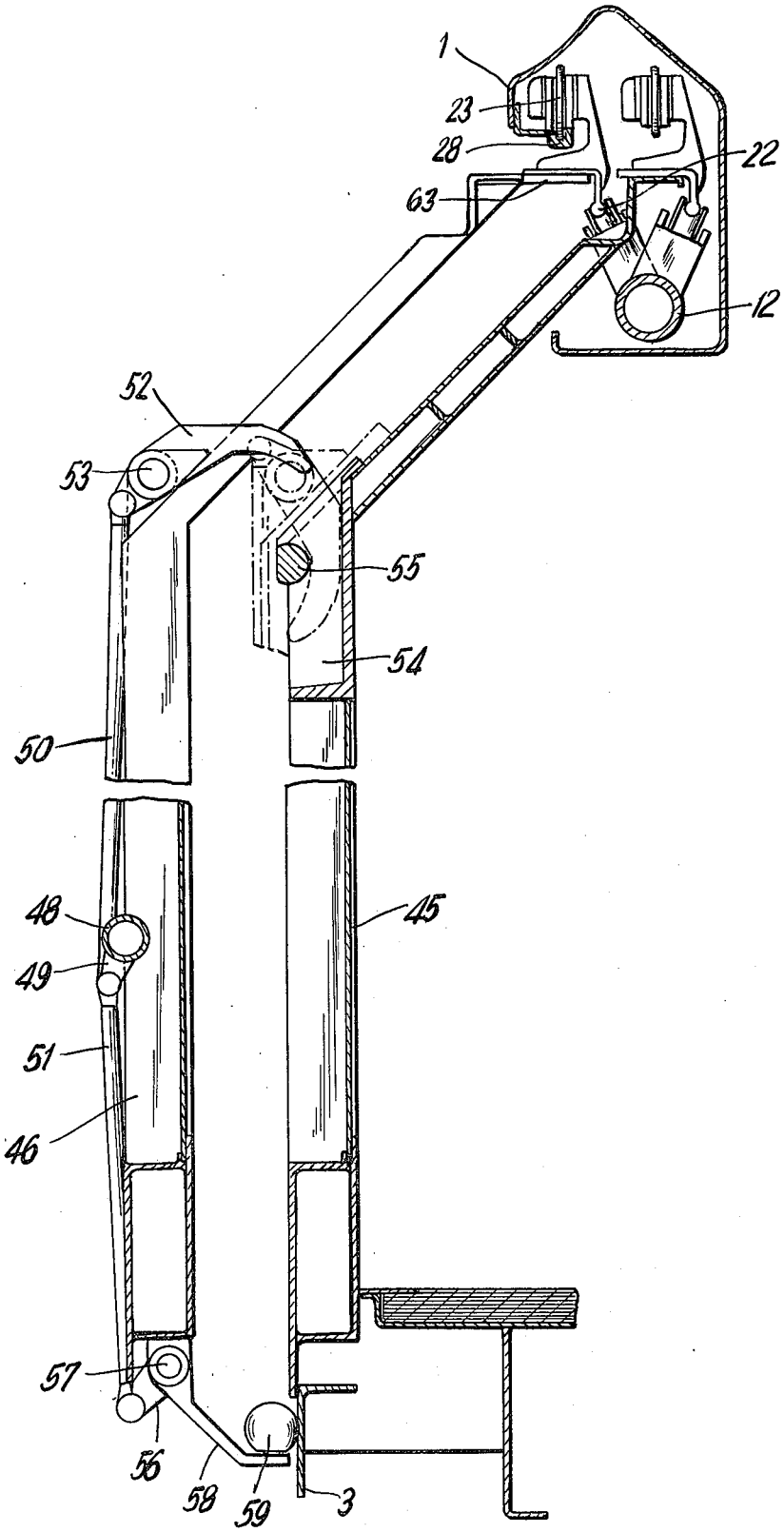
FIG. 3 is a sectional view taken along the line III—III of FIG. 1 and showing the central sliding wall section shifted over an end sliding wall section and, partly and diagrammatically, the closing position of the central sliding wall section.
Figure 4:
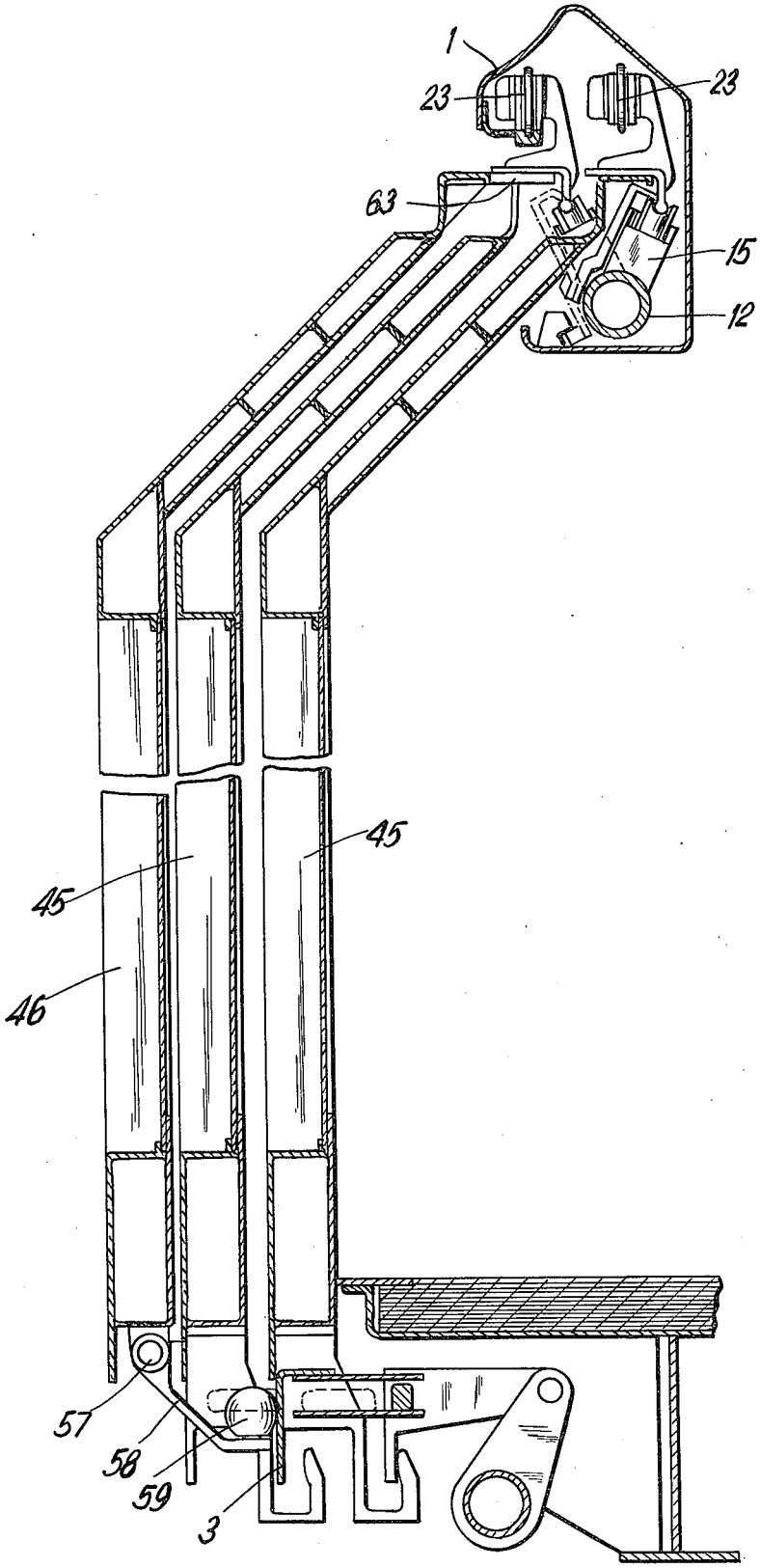
FIG. 4 is a sectional view taken along the line IV—IV of FIG. 1 showing the central and the end sliding wall sections in shifted position.

As in U.S. Pat. No. 3,828,693, the side wall frame of the sliding wall of a covered railroad freight car shown in FIG. 1 comprises a longitudinal upper stringer 1, corner posts 2 and an outer longitudinal beam 3 of the undercarriage. Intermediate posts are not provided in the embodiment in accordance with the invention. The aperture of the side wall frame is closed by two end sliding wall sections 45 and a central sliding wall section 46. In closing position, sliding wall sections 45 and 46 apply directly and tightly against the side wall frame. For opening, sliding wall sections 45 and 46 must be lifted out of their closing position, transversely of the longitudinal direction of the car, away from the side wall frame. For this purpose, in all cases, it is necessary to bring the central sliding wall section 46 into its shifting position and to displace it into a position in front of one of the end sliding wall sections 45.

For moving the central sliding wall section, a well known actuating mechanism 47 is provided on the section, with a handle, preferably, midway of the longitudinal extension of the section, which mechanism, upon swinging the handle, actuates the elements necessary for lifting the central section from the side wall frame. In the present example, the actuating mechanism 47 is not explained in more detail. It comprises, as usual in such cases, a safety device and customs seal. Horizontal shafts 48 extend to both the right and left of the handle of the mechanism, and are non-rotatably connected to the handle. At its free end projecting beyond the body of the central section, each shaft 48 carries a lwever 49 non-rotatably secured thereto. Each lever 49 is hinged to a connecting rod 50 extending upwardly and a connecting rod 51 extending downwardly.

The free end of each upwardly extending connecting rod 50 is hinged to one end of a respective two-armed catch lever 52 pivotally mounted on central sliding wall section 46 by means of pivots 53 extending horizontally in the longitudinal direction of the car. The free, sickle-shape, end of each catch lever 52 projects, past the adjacent edge of central sliding wall section 46, toward the adjacent end sliding wall section 45 and, in closing position, is introduced into a pocket 54 which is provided in the adjacent sliding wall section 45 at this location, i.e., at the end of this end section against the center of the car, and engages behind a catch member 55 extending horizontally in front of pocket 54.

The free end of each downwardly extending connecting rod 51 is hinged to a respective lever 56 which is non-rotatably secured to a respective pivot 57 which, in turn, is pivotally mounted on the bottom edge of central sliding wall section 46, with its axis extending horizontally in the longitudinal direction of the car. At least one angle lever 58 is secured to each pviot 57, having an axis of rotation coaxial with the axis of pivot 57. One of the free ends of each angle lever 58 carries a respective ball roller 59 which, for opening, and in the open position of central sliding wall section 46, applies against the vertical outer lateral surface of outer longitudinal beam 3. The other free end of each angle lever 58 is provided with a respective hook portion 60 which, in the closing position of central sliding wall section 46, projects through a cut-out 61 of outer longitudinal beam 3 and engages the inner lateral surface thereof.

Adjacent the ends of upper horizontal edge of central sliding wall section 46, running rollers 23 are mounted on brackets 62, for rotation about horizontal axes extending transversely of the car. Each bracket 62 further carries a supporting cam 22, and each roller 23 is engageable with a running rail 28 extending longitudinally and uninterruptedly through upper stringer 1. A hollow shaft 12 is mounted in upper stringer 1 for rotation about a horizontal, longitudinally extending axis, and carries at least two levers 15 designed, at their free ends, as guide forks, or having their free ends provided with running rollers 14. Shaft 12 is not connected to any actuating mechanism. Rollers 23, supporting cams 22, rail 28, shaft 12, levers 15 and rollers 14 correspond to substantially identically designed elements as disclosed in the mentioned U.S. Pat. No. 3,828,693. The design of the end sliding wall sections 45 and their actuating mechanism also corresponds to the respective provisions in the said U.S. patent and is therefore not described in more detail.

For shifting sliding wall sections 45 and 46, first, central sliding wall section 46 is lifted from its closing position on the side wall frame and brought into its shifting position. To this end, handle 47 of the actuating mechanism of central section 46 is swung down. Thereby, shafts 48 of actuating mechanism 47 are turned through about 180°. Levers 49 at the end of each shaft 48 shift the associated connecting rods 50 and 51 downwardly. Along therewith, catch levers 52 at the upper ends of conecting rods 50 are pivoted and the back sides of their free, sickle-shape, ends engage the walls of the associated pockets 54 of end sliding wall sections 45. By means of connecting rods 51, angle levers 58 are pivoted through levers 56. In consequence, ball rollers 59 apply against the outer lateral surface of outer longitudinal beam 3.

During further swinging of actuating mechanism 47, central sliding wall section 46 is lifted, above, by catch lever 52, and, below, by angle lever 58, from its closing position on the side wall frame into its shifting position. During this motion, section 46 is guided by supporting cams 22 which engage levers 15 through rollers 14. In th course of this opening motion, shaft 12 is turned so that the lifting of section 46 into the shifting position is positively guided. As soon as section 46 comes into the shifting position, running rollers 23 become seated on running rail 28. At the bottom of sliding wall section 46, now, after reaching the shifting position, ball rollers 59 on the ends of angle levers 58 occupy positions in which their axes extend approximately vertically. At the same time, in the shifting position, each catch lever 52 is pivoted completely out of the associated pocket 54 of an end sliding wall section 45. Due to a corresponding dimensioning of levers 15, catch levers 52 and angle levers 58, at the end of the swinging motion of sliding wall section 46, this section is lifted from the side wall frame through a distance corresponding approximately to the thickness of the central sliding wall section 46 and the thickness of one of the end sliding wall sections 45.

Now, section 46 can be shifted over one of the end sections 45. As soon as central sliding wall section 46 is shifted completely over one of the end sliding wall sections 45, this end section 45 can also be swung from its closing position, on the side wall frame, into its shifting position, in front of the side wall frame. This swinging motion is effected, in the manner described in U.S. Pat. No. 3,828,693, for the sliding wall sections. The actuating mechanisms for the end sliding wall sections are provided, also advantageously, on the corner posts 2. Since central sliding wall section 46 has been lifted, by the swinging motion, from its closing to its shifting position, through a distance corresponding to its own thickness and, in addition, to the thickness of the end sliding wall section, there is still enough space behind the displaced central sliding wall section for lifting the end sliding wall section 45.

At locations where the running rollers 23 of the end sliding wal section 45 are mounted behind the displaced central sliding wall section 46, cut-outs 63 are provided in the upper end of central sliding wall section 46, and have approximately the width of supporting arms 21 of running rollers 23 of the end sliding wall section so that running rollers 23 of end section 45 can touch down, without obstruction, on the single, rectilinear and uninterrupted running rail 28 in the upper stringer. Thereby, in accordance with the design of U.S. Pat. No. 3,828,693, the end sliding wall section 45 is lifted from the side wall frame through at least the thickness of one end sliding wall section. Due to the pivoting of running rollers 23 of the end sliding wall section into cut-outs 63 of the central sliding wall sections, an interengagement of the end section and the central section shifted thereover is obtained. Now, the two sliding wall sections 45 and 46 thus interengaged can be displaced together in front of the side wall frame into a position in front of the other end sliding wall section which is in closing position.

The closing of the sliding wall sections is effected in the inverse order. The two sliding wall sections displaced into a position in front of the end section which is in closing position are conjointly shifted into the end position of the opened exterior section. Then, by means of its actuating mechanism, this end sliding wall section is brought into its closing position on the side wall frame again. Thereupon, the central sliding wall section can be shifted toward the center of the car, in front of the closing position of this section. Mechanism 47 is then actuated and, thereby, connecting rods 50 and 51 are shifted upwardly. Because of the pivoting of angle levers 58, the central sliding wall section is moved toward outer longitudinal beam 3. At the upper edge, at the same time, catch levers 52 engage, by their sickle-shape free ends, behind catch members 55 of pockets 54 and pull section 46 against upper stringer 1. During this motion toward the side wall frame, sliding wall section 46 is guided by supporting cams 52, rollers 14, levers 15 and shaft 12 which is rotated about its longitudinal axis by the pulling of section 46 toward the side wall frame. Once in its closing position, central sliding wall section 46 is clamped, at the bottom edge, by the hooked portions 60 of angle levers 58, to outer longitudinal beam 3 and, at the top edge, by means of the sickle-shape ends of catch levers 52, which engage behind catch members 55 of end sliding wall sections 45.

In a variation of the described embodiment, and for facilitating the actuation, each catch member 55 may be provided with a roller against which the associated catch lever 52 applies. Further, for making the closure sure against erroneous manipulation, security devices in accordance with the mentioned U.S. patent may be provided on levers 15 of shaft 12. It is also possible to provide a through shaft instead of the pivots 57 at the lower edge of the central sliding wall section, in order to be able to mount a plurality of angle levers 58.

While a specific embodiment of the invention has been shown and described in detail to illustrate the application of the principles of the invention, it will be understood that the invention may be embodied otherwise without departing from such principles.

What is claimed is:

1. In a sliding wall arrangement for covered railroad freight cars, in which sliding wall sections, which are co-planar in the closed state and are movable, transversely of the car, by means of respective hand levers and actuating linkage connected thereto, out of the closing plane and into a shifting plane, are displaceable in the shifting plane, longitudinally of the car past closed wall sections, on rollers for opening of the sliding wall, with the rollers being engageable with a single, rectilinear and uninterrupted rail, provided in an upper longitudinal stringer of a side wall frame, and with the outer lateral surface of an outer lower longitudinal supporting beam of the side frame, the improvement comprising, in combination, said sliding wall arrangement having three sliding wall sections constituted by a central section and two end sections; each end section having, in the upper portion of its end adjacent the central section, an outwardly opening pocket having a catch member extending thereacross; said central section having, at the upper portion of each of its ends adjacent an end section, latch means selectively extendable into the adjacent pocket to engage behind the associated catch member in the closing position of said central section, to latch the upper portion of said central section in closing position; said outer supporting beam having longitudinally spaced cut-outs through its outer lateral surface; latching elements on said central section adjacent its lower edge each extendable through a respective cut-out, in the closing position of said central section, to engage the inner lateral surface of said outer supporting beam to latch the lower portion of said central section in closing position; actuating mechanism on said central section operatively connected to said latch means and said latch elements to operate the same conjointly between latching and unlatching positions; guiding means mounted on said upper stringer and guiding said central section during movement thereof between said closing and shifting planes; and respective means operable to shift each end section, when overlapped by said central section, between said closing and shifting planes.

2. In a sliding wall arrangement for covered railroad freight cars, the improvement claimed in claim 1, in which each catch member extends horizontally across the front opening of the associated pocket; each said latch means comprising a sickle-shape catch lever pivotally mounted for pivoting about a horizontal axis extending parallel to the length of said car.

3. In a sliding wall arrangement for covered railroad freight cars, the improvement claimed in claim 1, in which said latching elements comprise angle levers secured to a horizontal pivot extending longitudinally of said car; each angle lever rotatably mounting, at one end thereof, a respective ball roller and having, at its other free end, a respective hook portion; said hook portions, in the closing position of said sliding wall sections, extending through the respective cut-outs to engage the inner lateral surface of said outer supporting beam; said actuating mechanism pivoting said angle levers between the latching and unlatching positions thereof.

4. In a sliding wall arrangement for covered railroad freight cars, the improvement claimed in claim 3, in which said ball rollers are rotatable about axes which, in the unlatching positions of the associated angle levers, extend vertically with said ball rollers engaging the outer lateral surface of said outer lower longitudinal supporting beam.

5. In a sliding wall arrangement for covered railroad freight cars, the improvement claimed in claim 1, in which said guiding means comprises a horizontal shaft extending longitudinally of said car and rotatably mounted on said upper stringer in the zone of central wall section; at least two upwardly projecting levers secured to said horizontal shaft to extend therefrom; and supporting arms on the upper horizontal edge of said central section engageable with the free ends of said upwardly projecting levers.

6. In a sliding wall arrangement for covered railroad freight cars, the improvement claimed in claim 5, in which the free ends of said upwardly projecting levers are formed as guide forks engaging said supporting arms.

7. In a sliding wall arrangement for covered railroad freight cars, the improvement claimed in claim 5, including rollers rotatably mounted in the free ends of said upwardly projecting levers and engaged by said supporting arms.

8. In a sliding wall arrangement for covered railroad freight cars, the improvement claimed in claim 2, in which each catch member comprises a shaft; and a roller rotatably mounted on said shaft and engageable by the associated catch lever.

9. In a sliding wall arrangement for covered railroad freight cars, the improvement claimed in claim 1, in which each wall section has, at its upper edge, supporting arms carrying the rollers engageable with said single, rectilinear and uninterrupted rail; said central sliding wall section being formed, at its upper edge, with cut-outs each having a width at least equal to the width of said last mentioned supporting arms and provided at locations which, with said central sliding wall section in fully opened position and displaced into overlapping relation with an end wall section, are aligned with the roller supporting arms of the overlapped end section.

10. In a sliding wall arrangement for covered railroad freight cars, the improvement claimed in claim 3, in which said angle levers are secured to a common shaft rotatably mounted to extend along and parallel to the lower edge of said central sliding wall section.

* * * * *